US006972782B2

(12) United States Patent
Terao et al.

(10) Patent No.: US 6,972,782 B2
(45) Date of Patent: Dec. 6, 2005

(54) THERMAL HEAD

(75) Inventors: Hirotoshi Terao, Fukushima-ken (JP); Tomoko Wauke, Fukushima-ken (JP); Hisashi Hoshino, Fukushima-ken (JP); Tsuneyuki Sasaki, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/042,016

(22) Filed: Jan. 25, 2005

(65) Prior Publication Data

US 2005/0162506 A1 Jul. 28, 2005

(30) Foreign Application Priority Data

Jan. 26, 2004 (JP) ..... 2004-017080

(51) Int. Cl.[7] ..... B41J 2/34
(52) U.S. Cl. ..... 347/203
(58) Field of Search ..... 347/200, 201, 347/202–203, 211; 400/120.01

(56) References Cited

U.S. PATENT DOCUMENTS 5,223,855 A * 6/1993 Ota et al. ..... 347/209
5,305,021 A * 4/1994 Ota et al. ..... 347/201
6,028,619 A 2/2000 Saita et al.
6,407,764 B1 * 6/2002 Susukida et al. ..... 347/209
6,429,887 B2 * 8/2002 Obata et al. ..... 347/200

FOREIGN PATENT DOCUMENTS

JP 2003-072125 3/2003
JP 2004-230582 8/2004

* cited by examiner

*Primary Examiner*—K. Feggins
(74) *Attorney, Agent, or Firm*—Brinks Hofer Gilson & Lione

(57) ABSTRACT

In order to reduce creases of an ink film so as to offer excellent printing quality, a thermal head for use in a thermal-transfer printer includes a heat-insulating layer; a first projection serving as a part of the heat-insulating layer; a heating element formed on the first projection; common and individual electrodes connected to the heating element; a driver IC connected to these two electrodes; a sealing member sealing the driver IC; and a second projection protruding upstream, with respect to the transport route of the ink film, of the center of a section where the heating element comes into contact with a platen, so as to lie beyond a line connecting the apexes of the first projection and the sealing member.

8 Claims, 3 Drawing Sheets

THERMAL HEAD

This application claims the benefit of priority to Japanese Patent Application No. 2004-017080, filed on Jan. 26, 2004, herein incorporated by reference.

BACKGROUND OF THE INVENTION

1. Field of the Invention

The present invention relates to a thermal head for use in a thermal-transfer printer in which printing is performed by transferring ink of an ink film onto a paper sheet.

2. Description of the Related Art

Hitherto, a known thermal-transfer printer has a structure in which printing is performed by heating heating elements of a thermal head so as to transfer ink applied on the upper surface of an ink film such as an ink ribbon or an ink sheet onto a sheet of paper (hereinafter, simply referred to as a paper sheet. The thermal-transfer printer having such a structure is in heavy use as an output device of a computer, a facsimile machine, a word-processor, a digital still camera, and the like, thanks to its high recording quality, low-noise, low cost, easy maintenance, and so forth.

The structure of the known thermal head will be described with reference to FIG. 4. FIG. 4 is a schematic view of the sectional structure of a known thermal head 101.

As shown in FIG. 4, the known thermal head 101 has a heat-insulating layer 103 formed on the upper surface of a heat-radiating substrate 102. The heat-insulating layer 103 has a projection 103*a* formed in the vicinity of one end 102*a* of the substrate 102, having a substantially arch-shaped cross-section and protruding with a predetermined height. The thermal head 101 also has a heating resistor 104 formed on a part of the upper surface of the heat-insulating layer 103 including the projection 103*a*, and the heating resistor 104 has a common electrode 105 and an individual electrode 106 formed at both ends thereof, for supplying electric energy to the heating resistor 104. A section sandwiched between the common and individual electrodes 105 and 106 of the heating resistor 104 serves as a heating element 104*a* generating heat when electric energy is supplied from the common and individual electrodes 105 and 106, and a plurality of the heating elements 104*a* are formed almost linearly in a dot array so as to be perpendicular to the plane of FIG. 4.

Also, the heating element 104*a*, the common and individual electrodes 105 and 106 have a protecting layer (not shown) deposited on the surfaces thereof so as to be prevented from oxidization and wear.

Further, the substrate 102 has a driver IC 107 disposed closed to the other end 102*b* thereof, connecting to the common and individual electrodes 105 and 106 and sealed with a sealing member 108. Also, the substrate 102 has a terminal section 109 extending from the other end 102*b* thereof, composed of an FPC (flexible circuit board) or the like.

FIGS. 5A and 5B are schematic sectional views of the known thermal head 101, illustrating its printing operation. When printing is performed with the thermal head 101, as shown in FIGS. 5A and 5B, the heating element 104*a* of the thermal head 101 comes into contact with a platen 110 through an ink film 111 (indicated by a dotted line in FIG. 5) and a paper sheet 112 (indicated by a dotted chain line in FIG. 5) (hereinafter, a section where the heating element 104*a* and the platen 110 come into contact with each other is called "an abutment section", and its center is called "an abutment position"), and also, the ink film 111 and the paper sheet 112 are moved in the arrow direction. Thus, by selectively heating a plurality of the heating element 104*a* on the basis of printing information so as to heat the ink film 111, ink of the ink film 111 is transferred onto a recording medium, whereby the paper sheet 112 is subjected to printing of a character, an image, and so forth.

In the known thermal-transfer printer, a member for eliminating slackness of the ink film 111 so as to prevent the ink film 111 from creasing at the abutment section is disposed in the transport route of the ink film 111.

In the known thermal-transfer printer, as the members for eliminating slackness, rollers 113 and 114 are disposed upstream with respect to the transport route of the ink film 111 (close to a virgin portion of the ink film 111) so as to provide a tension to the ink film 111 (see FIG. 1 disclosed in Japanese Unexamined Patent Application Publication No. 2001-1620) as shown in FIG. 5A.

Alternatively, as shown in FIG. 5(B), a guide plate 115 (also, called a ribbon guide) is disposed upstream with respect to the transport route of the ink film 111 so as to provide a tension to the ink film 111 for eliminating slackness of the ink film 111 (see FIG. 1 disclosed in Japanese Unexamined Patent Application Publication No. H8-156361).

Unfortunately, in the above-described known thermal-transfer printer, even when creases of the ink film 111 are removed once with the members 112, 113, and 114 disposed for eliminating slackness of the ink film 111, there is a risk that the ink film 111 experiences slackness again before being transported to the abutment section between the heating element 104*a* of the thermal head 101 and the platen 110 and resultantly creases.

This risk is unavoidable since the foregoing members 112, 113, and 114 are disposed independently from the thermal head 101. That is, the rollers 112 and 113 shown in FIG. 5A are disposed in the main body of the thermal-transfer printer or in a casing (a cartridge) having an ink film accommodated therein, and the guide plate 115 shown in FIG. 5B is disposed, for example, to a thermal head unit holding the thermal head 101.

In addition, in order to increase the number of thermals heads 101 formed on a single of the substrate 102, an attempt has been made in recent years such that the thermal head 101 has a reduced size, especially a reduced length (the length from the end 102*a* to the end 102*b* of the substrate 102 shown in FIG. 4) parallel to the transport direction of the ink film 111. Since the reduced length of the thermal head 101 causes the projection 103*a* to be closer to the driver IC 107 and the sealing member 108, when the platen 110 and the thermal head 101 are arranged in the same way as in the known art, the driver IC 107 and the sealing member 108 sometimes come into contact with the platen 110. In order to avoid this contact, an abutment angle of the thermal head 101 relative to the platen 110 must be made greater in comparison to the related art. Meanwhile, an abutment angle is defined by an angle made by the thermal head 101 with respect to the tangent of the platen 110 at the abutment position between the thermal head 101 and the platen 110.

While smoothly entering the abutment section as long as the thermal head 101 has a small abutment angle, the ink film 111 is apt to be lodged when the thermal head 101 has a large abutment angle.

Furthermore, although the thermal head 101 comes into contact with the ink film 111 and irons out its creases upstream of the abutment position when the thermal head 101 has a small abutment angle, when the thermal head 101 has a large abutment angle, a contact area formed between the thermal head 101 and the ink film 111 becomes smaller upstream of the abutment position, whereby creases of the ink film 111 become more strongly influential to printing quality, thus resulting in deteriorated printing quality.

SUMMARY OF THE INVENTION

The present invention has been made in view of the above-mentioned problems, and it is an object of the present invention to provide a thermal head reducing creases of an ink film and resultantly offering excellent printing quality when used in a thermal-transfer printer.

In order to achieve the above-mentioned object, a thermal head according the present invention, having a structure in which a heating element formed on a first projection is heated between itself and a platen with which the heating element comes into contact through a recording medium and an ink film, so as to transfer ink of the ink film onto the recording medium, includes a driver IC connected to electrodes extending from the heating element; a sealing member sealing the driver IC; and a second projection protruding upstream, with respect to the transport route of the ink film, of the center of a section where the heating element comes into contact with the platen, so as to lie beyond a line connecting the apexes of the first projection and the sealing member.

Also, in order to achieve the above-mentioned object, a thermal head according the present invention, having a structure in which a heating element formed on a first projection is heated between itself and a platen with which the heating element comes into contact through a recording medium and an ink film, so as to transfer ink of the ink film onto the recording, medium, includes a second projection lying upstream, with respect to the transport route of the ink film, of the center of a section where the heating element comes into contact with the platen; and a non-contact section, lying from the section where the heating element of the first projection comes into contact with the platen to the second projection, so as to prohibit contact with the ink film therein.

In the thermal head according the present invention, the second projection may include a guide in contact with the transport route of the ink film.

Further, in the thermal head according the present invention, the guide may extend along the transport route of the ink film by a length of at least 50 $\mu$m.

Furthermore, in the thermal head according the present invention, the guide may extend upstream of the center of the section where the heating element comes into contact with the platen, starting at a position away from the center by a distance of 200 to 500 $\mu$m.

DESCRIPTION OF THE PREFERRED EMBODIMENTS

Figure 1:
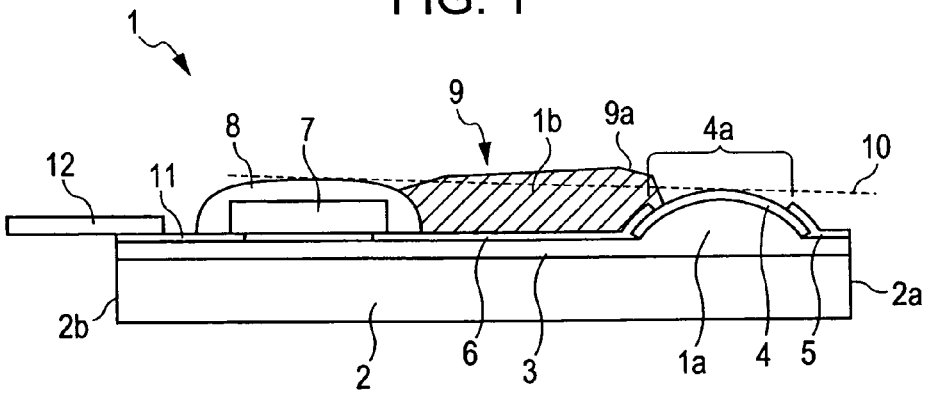
FIG. 1 is a general sectional view of the overall structure of a thermal head according to the present invention.

An embodiment of the present invention will be described with reference to FIGS. 1 to 3. FIG. 1 is a schematic sectional view of the overall structure of a thermal head 1 according the present invention, FIG. 2 is a schematic sectional view of the thermal head 1, illustrating its printing operation, and FIG. 3 is a magnified view of an essential part of the thermal head 1.

Figure 2:
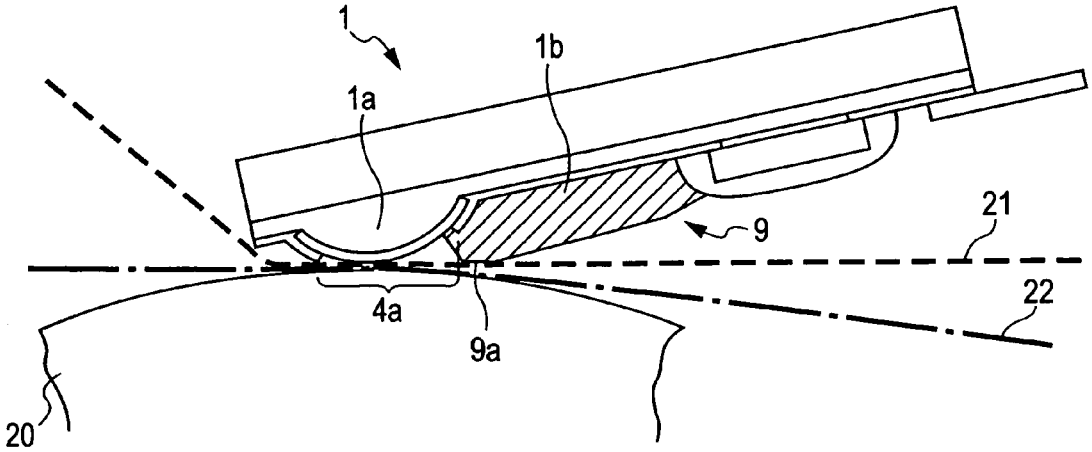
FIG. 2 is a general sectional view of the thermal head, illustrating its printing operation.
Figure 3:
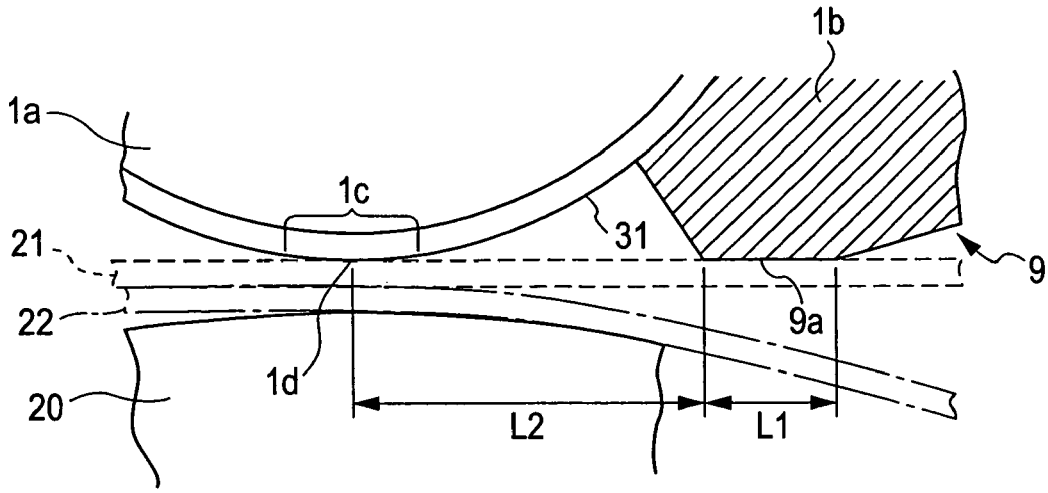
FIG. 3 is a magnified illustration of an essential part of the thermal head.
Figure 4:
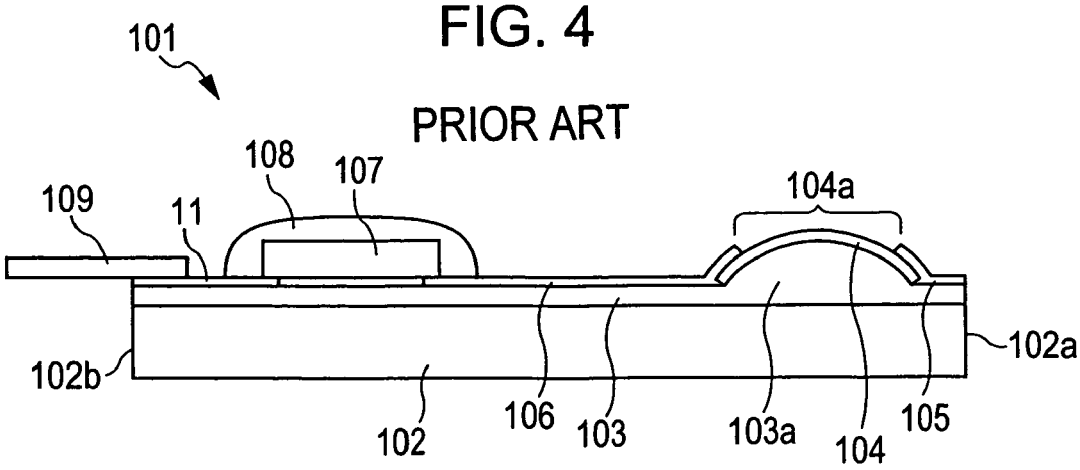
FIG. 4 PRIOR ART
FIG. 4 is a general sectional view of the overall structure of a known thermal head.
Figure 5A:
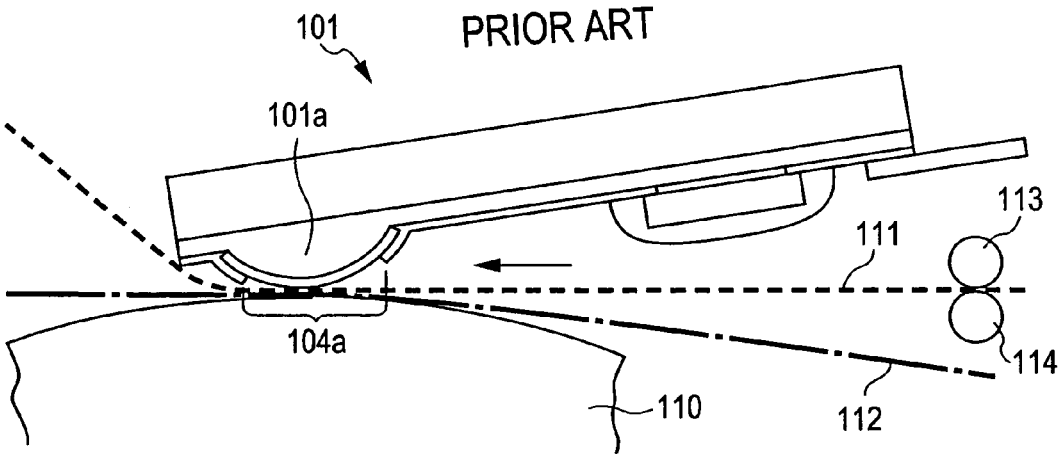
FIG. 5A PRIOR ART
FIGS. 5(A) and (B) are general sectional views of the known thermal head, illustrating its printing operation.
Figure 5B:
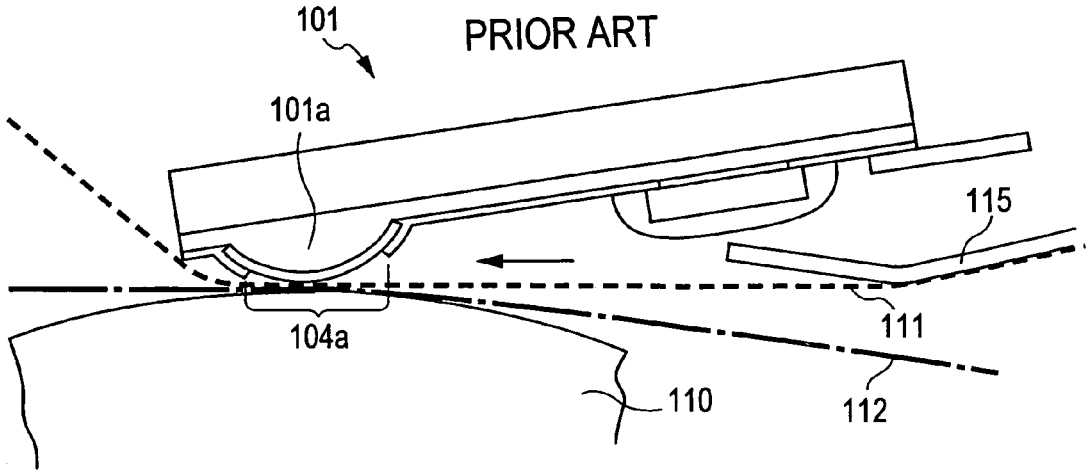
FIG. 5B PRIOR ART

As shown in FIGS. 1 and 2, the thermal head 1 according the present invention has a structure in which a plurality of heating elements 4*a* are linearly formed on respective first projections 1*a* serving as a part of a heat-insulating layer 3 and, with respect to each heating element 1*a*, includes a driver IC 7 connected to a common electrode 5 and an individual electrode 6 extending from the heating element 4*a*; a sealing member 8 sealing the driver IC 7, and a second projection 1*b* lying upstream, with respect to the transport route of an ink film 21, of an abutment position 1*d* (see FIG. 3) serving as the center of an abutment section 1*c* (see FIG. 3) where the heating element 4*a* and a platen 20 come into contact with each other.

As shown in FIG. 1, the first projection 1*a* of the thermal head 1 is disposed close to one end 2*a* of a substrate 2 by processing the heat-insulating layer 3 deposited on the substrate 2 by lithography or the like. The substrate 2 of the thermal head 1 is a heat-radiating one, and the heat-insulating layer 3 is a heat-insulating gazed one or the like.

The first projection 1*a* has the heating element 4*a* formed on the upper surface thereof, and, as shown in FIG. 2, the thermal head 1 in operation is declined at a predetermined abutment angle so that the heating element 4*a* comes into contact with the platen 20 through the ink film 21 and a recording medium 22 (respectively shown by a dotted line and a dotted-chain line indicated in FIG. 2).

The first projection 1*a* is appropriately designed so as to have a shape suitable for coming into contact with the platen 20, taking account of an abutment angle, an abutment position and so forth of the thermal head 1 with respect to the platen 20. For example, the first projection 1*a* is formed so as to have a sectional shape having a curved surface with a radius of curvature of 1.5 to 4 mm. The heating element 4*a* is formed by patterning a heating resistor 4, with photolithography or the like, obtained by depositing a film on the upper surface of the first projection 1*a*, for example, by sputtering Ta—N, Ta—$SiO_2$, or the like. Also, the common and individual electrodes 5 and 6 are formed by sputtering Al, Cu, Au or the like and depositing and patterning it by photolithography or the like. In general, the common and individual electrodes 5 and 6 are respectively formed close to the one end 2*a* and the other end 2*b* of the substrate 2.

As shown in FIG. 2, the plurality of the heating elements 4*a* in operation come into contact with the platen 20 through the ink film 21 and the recording medium 22 and form the respective abutment sections 1*c* (see FIG. 3); thus, when selectively energized in this state, the heating elements 4*a* generate heat so as to transfer ink of the ink film 21 onto the recording medium 22 for performing printing.

The driver IC 7 is disposed close to the other end 2*b* of the substrate 2 and connected to the common and individual electrodes 5 and 6 extending from the heating element 4*a*. The driver IC 7 controls, for example, the voltage of an energizing pulse to be supplied to each heating element 4*a* and controls the heat value of the heating element 4*a*. The driver IC 7 is sealed by the sealing member 8 for protection from external factors such as mechanical and thermal stresses, moisture, and so forth.

As the arrangement of the driver IC 7 and the sealing member 8, as shown in FIG. 1, a COB (chip on board) in which the driver IC 7 is directly mounted on the common and individual electrodes 5 and 6 on the substrate 2, and in which the mounting area is sealed by the sealing member 8 may be used, or the driver IC 7 may be mounted on the thermal head 1 after being packaged by a sealing member.

The second projection 1*b* of the thermal head 1 is disposed upstream, with respect to the transport route of the ink film 21, of the abutment position 1*d* where the heating element 4*a* and the platen 20 come into contact with each other, (in FIG. 1, close to the other end 2*b* of the substrate 2). In general, as shown in FIGS. 1 and 2, since the ink film 21 is supplied from the side on which the driver IC 7 and the sealing member 8 are disposed, toward the heating element 4*a*, the driver IC 7 and the sealing member 8 lie upstream of the abutment position 1*d* with respect to the transport route of the ink film 21.

Although the second projection 1*b* may be formed by independently depositing an additional projection layer 9 on the individual electrode 6 and so forth as shown in FIG. 1, it may be formed by making a part of the substrate 2 or the heat-insulating layer 3 thick.

When the second projection 1*b* protrudes beyond a line 10 (indicated by a dotted line in FIG. 1) connecting the apexes of the first projection 1*a* and the sealing member 8, the thermal head 1 has a reduced angle relative to the ink film 21 upon entry of the ink film 21 into the abutment section 1*c*. As a result, the ink film 21 smoothly enters the abutment section 1*c* and is resultantly prevented from being lodged and creasing upstream of the abutment section 1*c*.

Also, when the second projection 1*b* is disposed close to the abutment position 1*d*, the heating element 4*a* is not sufficiently heated, and its function of transferring ink of the ink film 21 is consequently inhibited. Hence, the thermal head 1 preferably has a non-contact section 31 lying from the abutment section 1*c* of the first projection 1*a* to the second projection 1*b* so as to prohibit contact with the ink film 21 therein.

Further, the second projection 1*b* preferably includes a guide 9*a* in contact with the transport route of the ink film 21. The guide 9*a* contacts the ink film 21 upstream with respect to the transport route of the ink film 21 and irons out creases of the ink film 21. Since the guide 9*a* for eliminating slackness of the ink film 21 is disposed in the thermal head 1 itself as described above, creases of the ink film 21 are ironed out at a position very closed to the abutment section 1*c*, thereby reducing a risk that slackness of the ink film 21 causing creases is generated again up to the abutment section 1*c*.

The guide 9*a* preferably extends along the transport route of the ink film 21 by a length of at least 50 μm (a distance L1 shown in FIG. 3). With this structure, creases of the ink film 21 are more effectively eliminated.

Also, the guide 9*a* preferably extends upstream with respect to the transport route of the ink film 21, starting at a position away from the abutment position 1*d* by a distance of 200 to 500 μm (a distance L2 shown in FIG. 3). This is because, when the heating element 4*a* has a cross sectional shape with a radius of curvature of 1.5 to 4 mm, no guide 9*a* preferably exists in a section extending from the abutment position 1*d* to the foregoing position by a distance of 200 to 500 μm in order to keep an area in which the heating element 4*a* functions. Meanwhile, the distance L2 has a range of certain values, since the curvature of radius of the heating element 4*a* has a range of 1.5 to 4 mm.

Although the guide 9*a* has a flat surface in FIGS. 1 to 3, it may have a curved surface, with its cross-section having a curved shape extending along the transport route of the ink film 21.

What is claimed is:

1. A thermal head having a structure in which a heating element formed on a first projection serving as a part of a heat-insulating layer is heated between the heating element and a platen with which the heating element comes into contact through an ink film and a recording medium, so as to transfer ink of the ink film onto the recording medium, comprising:

a heat-insulating layer;

a driver IC connected to electrodes extending from the heating element; a sealing member sealing the driver IC; and a second projection protruding upstream, with respect to a transport route of the ink film, of a center of a section where the heating element comes into contact with the platen, so as to lie beyond a line connecting the apexes of the first projection and the sealing member.

2. The thermal head according to claim 1, wherein the second projection comprises a guide in contact with the transport route of the ink film.

3. The thermal head according to claim 2, wherein the guide extends along the transport route of the ink film by a length of at least 50 μm.

4. The thermal head according to claim 3, wherein guide extends upstream of the center of the section where the heating element comes into contact with the platen, starting at a position away from the center by a distance of 200 to 500 μm.

5. A thermal head having a structure in which a heating element formed on a first projection serving as a part of a heat-insulating layer is heated between the heating element and a platen with which the heating element comes into contact through an ink film and a recording medium, so as to transfer ink of the ink film onto the recording medium, comprising:

a second projection lying upstream, with respect to a transport route of the ink film, of a center of a section where the heating element comes into contact with the platen; and a non-contact section, disposed from the section where the heating element of the first projection comes into contact with the platen to the second projection, so as to prohibit contact with the ink film therein.

6. The thermal head according to claim 5, wherein the second projection comprises a guide in contact with the transport route of the ink film.

7. The thermal head according to claim 6, wherein the guide extends along the transport route of the ink film by a length of at least 50 μm.

8. The thermal head according to claim 7, wherein the guide extends upstream of the center of the section where the heating element comes into contact with the platen, starting at a position away from the center by a distance of 200 to 500 μm.

* * * * *